US005366066A

United States Patent [19]

Boot

[11] Patent Number: 5,366,066

[45] Date of Patent: Nov. 22, 1994

[54] AUTOMATIC BRICK PLACING MACHINE LOADER

[75] Inventor: Phillip H. Boot, Sydney, Australia

[73] Assignee: Panelbrick Industries Pty. Limited, Australia

[21] Appl. No.: 70,323

[22] PCT Filed: Dec. 3, 1991

[86] PCT No.: PCT/AU91/00561

§ 371 Date: Jun. 1, 1993

§ 102(e) Date: Jun. 1, 1993

[87] PCT Pub. No.: WO92/10626

PCT Pub. Date: Jun. 25, 1992

[30] Foreign Application Priority Data

Dec. 4, 1990 [AU] Australia ..... PK 3702

[51] Int. Cl.[5] ..... B65G 47/12

[52] U.S. Cl. ..... 198/458

[58] Field of Search ..... 198/458; 52/749

[56] References Cited

U.S. PATENT DOCUMENTS 3,148,761 9/1964 Niederer et al. ..... 198/458 X 4,067,766 1/1978 Larger ..... 156/297

5,016,419 5/1991 Boot et al. ..... 52/749

FOREIGN PATENT DOCUMENTS

23105/88 3/1989 Australia .

599266 12/1990 Australia .

63675/90 3/1992 Australia .

668454 11/1929 France .

3614935 11/1987 Germany .

*Primary Examiner*—Cheryl L. Gastineau

*Attorney, Agent, or Firm*—Christie, Parker & Hale

[57] ABSTRACT

A loader for an automatic brick placing machine consisting of a frame (14) attached to a receptacle (10) of the machine to move with it. The loader having a plurality of stations for the reception of bricks for loading into the receptacle and an arrangement of rollers, stops and conveyors (16, 17, 20, 22) to space the bricks apart at an appropriate distance and to move them towards the receptacle while arranging the bricks in such a manner that bricks in the correct positions and quantities are fed to the receptacle (10) to form a brick panel of a predetermined configuration. The whole being controlled by a programmable logic controller.

6 Claims, 8 Drawing Sheets

AUTOMATIC BRICK PLACING MACHINE LOADER

The present invention relates to an automatic brick placing machine loader intended for use in conjunction with a brick placing machine such as that described in the specification of Australian Patent 599266.

While the brick placing machine described in that specification has been found to function very satisfactorily some shortcomings have been noted in relation to the loading of the machine. The receptacle of the machine cannot be reloaded until a cycle of operations has been completed and the receptacle returned to the loading position. With standard bricks the loading time for a full receptacle using two operators is approximately 40 seconds and the overall machine cycle time is approximately 68 seconds. By using more labour the loading time could be decreased but not significantly. If a smaller brick size were used necessitating the loading of more brick elements into the receptacle the loading time would increase and not decrease.

Consideration of the economics of the operation of the machine reveals that the cycle time of the brick placing machine is critical to commercial viability, in fact more critical than the labour content to operate it, due to the available time for the brick placing activity during a 12 hour brick manufacturing cycle.

The object of the present invention is to provide an automatic brick placing machine loader capable of loading the brick placing machine receptacle in a time of the order of 5 seconds utilizing one operator and any sized brick and reducing the overall cycle time to under 30 seconds. The fact that this can be achieved with smaller bricks is significant as, while greater productivity can be achieved and labour costs lowered with larger brick elements these are far less popular than the smaller bricks as a result of which brick manufacturers are reluctant to supply larger bricks.

The present invention consists in a loader for an automatic brick placing machine consisting of a frame, means for attachment of the frame to a receptacle of a brick placing machine for translational movement therewith, a plurality of motor driven rollers for the receipt of bricks arranged on the frame, said rollers being arranged in parallel at a plurality of stations and being constructed and arranged to move bricks towards a station from which the bricks are transferred to a brick placing machine, said stations including a first station having means for receiving a row of bricks in a close side by side configuration and moving said bricks into a configuration in which they are equally spaced apart at a predetermined interval, means at each station actuable to prevent movement of any brick caused by the rotation of one of said rollers, a final station for receiving a predetermined number of bricks arranged in predetermined position in accordance with the requirements of the brick placing machine in the formation of a brick panel, means to transfer said last mentioned bricks from the said final station to a receptacle of a brick placing machine while preserving the relative positions of said bricks, a pre-final station prior to said final station having means for moving bricks received from a previous station along the pre-final station to predetermined positions for transfer to the final station and a programmable logic controller or other like control device programmed to control the movement of moving parts of the machine to effect movement of bricks through the machine to transfer bricks to the brick placing machine in accordance with the requirements of a brick panel being formed by the brick placing machine.

In order that the nature of the invention may be better understood a preferred form thereof is hereinafter described by way of example with reference to the accompanying diagrammatic drawings in which.

Figure 1:
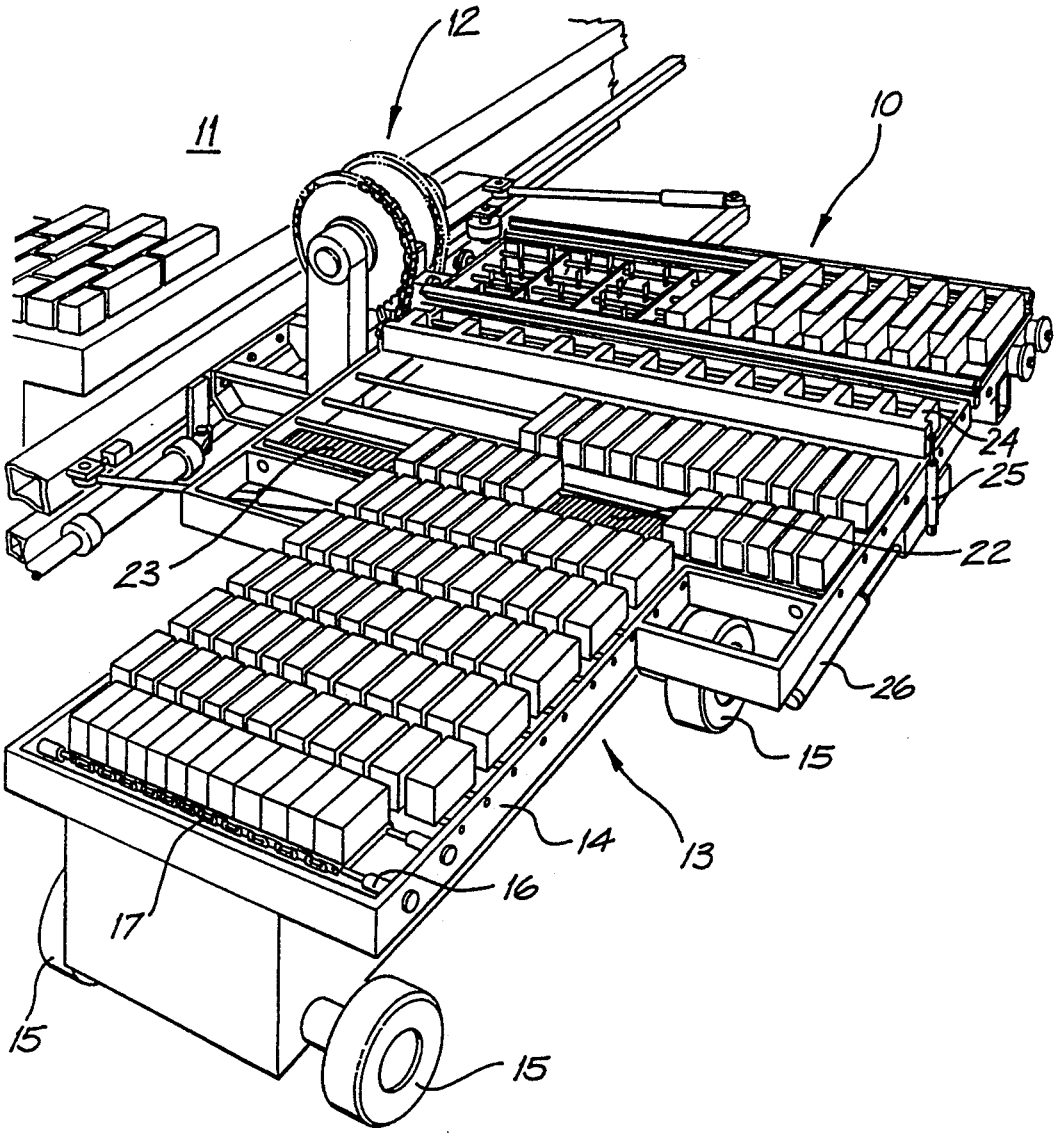
FIG. 1 is a perspective view of an automatic brick placing machine loader according to the invention arranged adjacent a brick placing machine.
Figure 4:
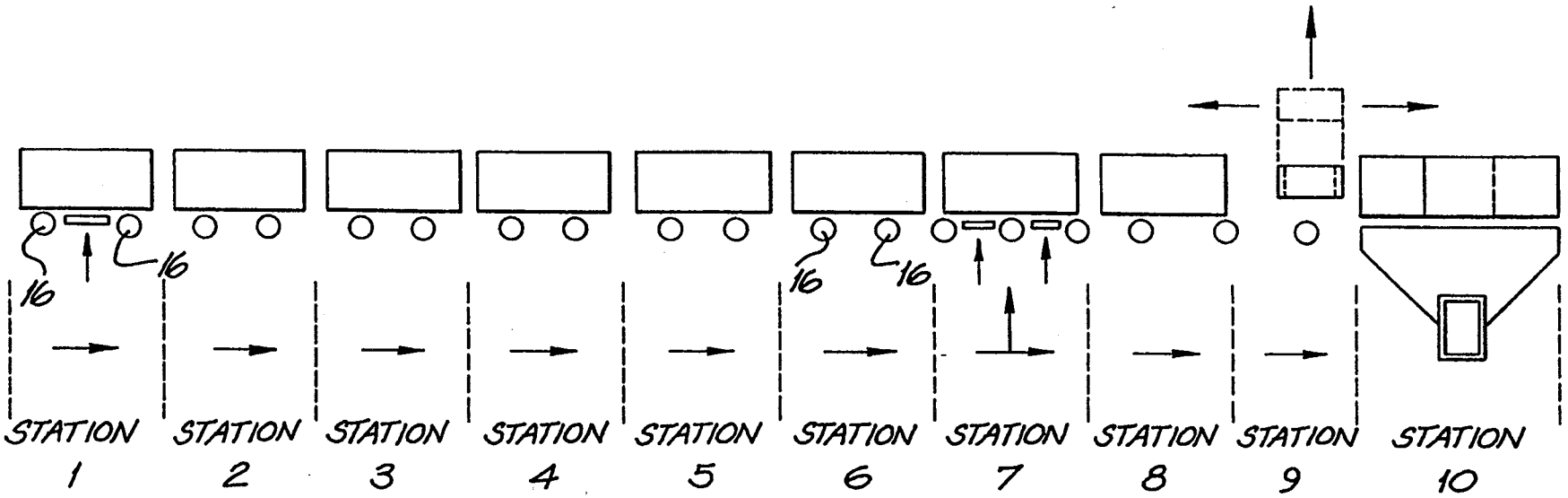
FIG. 4 illustrates diagrammatically the relationship between the various stations of the loader.
Figure 10:
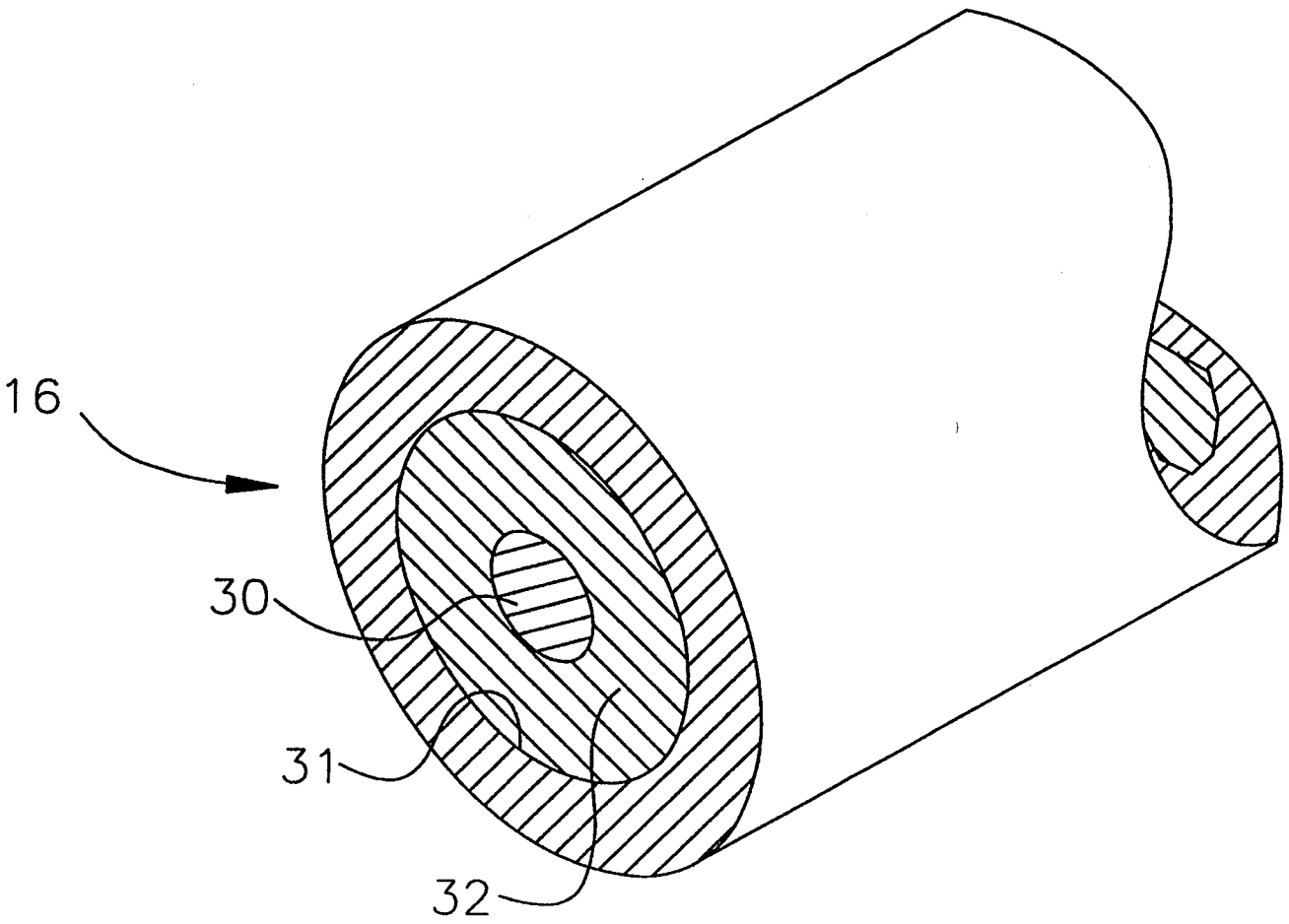
FIG. 10 is a semi schematic cross-sectional view of a roller used in the loader.

In FIG. 1 the brick receptacle arm of a brick placing machine as described in As shown in FIG. 10, the specification of Australian Patent 599266 is shown at 10 and the mechanism by which the receptacle is rotated onto the horizontal mould 11 is shown at 12. The brick loader 13 consists of a frame 14 supported on four ground engaging wheels 15 of which only three are shown in FIG. 1. The fourth is however shown in FIGS. 6, 7 and 8. The frame 14 supports a series of horizontal rollers at a series of nine stations as indicated in FIG. 4, there being two rollers 16 at each station up to station 6 and at station 8. Station 7 has three rollers and station 9 a single roller. As shown in FIG. 10, the rollers 16 are rotated about their axes by motors (not shown) each roller consisting of a central axle 30 rotating within an external tube and being connected to the tube 31 by a clutch 32. The central axles rotate at all times but the tubes cease rotating by the action of the clutch if bricks that they are carrying are caused to stop in the manner described below.

Figure 2:
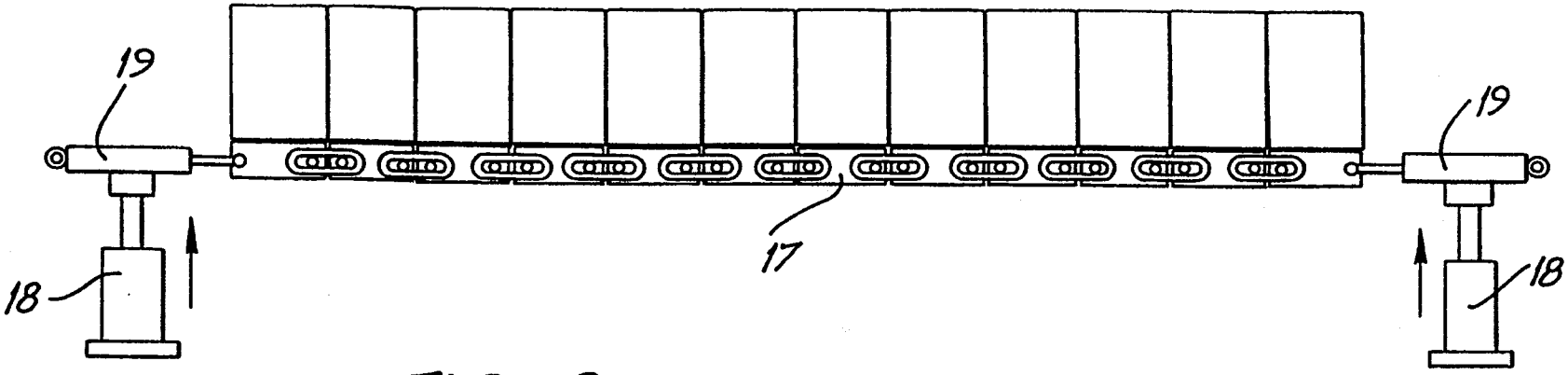
FIGS. 2 and 3 are views in elevation illustrating the operation of a belt for spreading bricks apart at station No. 1.
Figure 3:
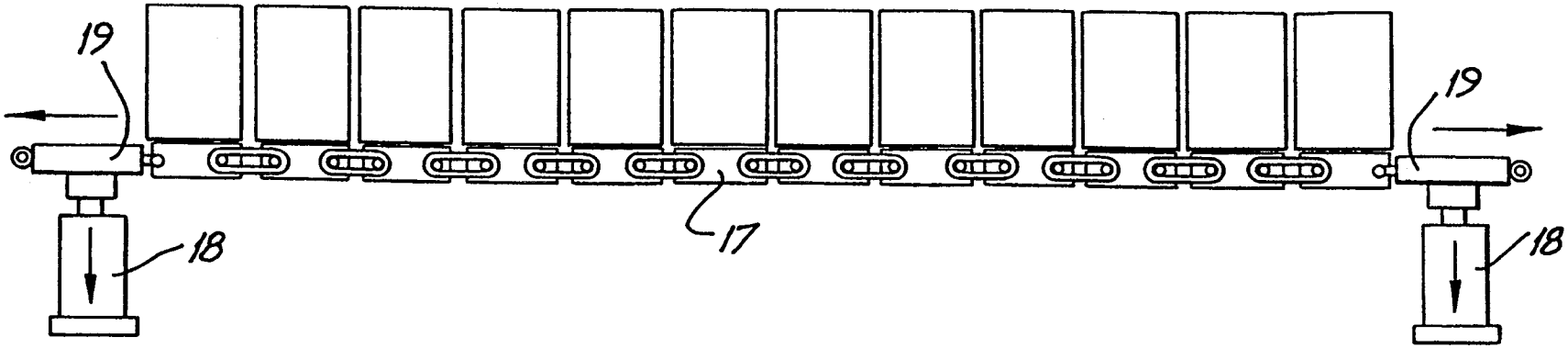
Figure 5:
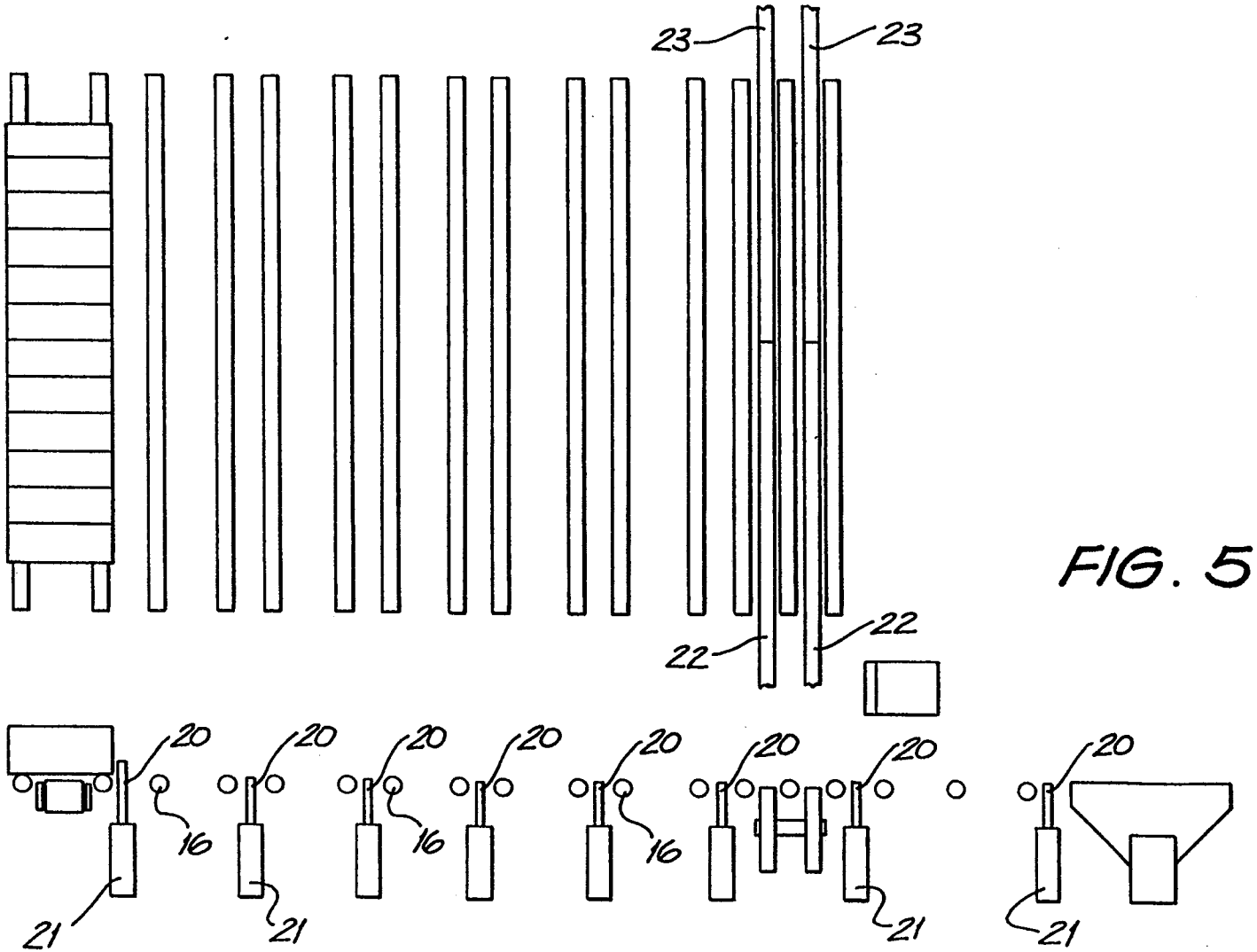
FIG. 5 illustrates diagrammatically the relationship between the various rollers, belts and stops of the loader.

The structure of the loader is best described in connection with its mode of operation and, while in FIG. 1 the loader is shown with a full load of bricks it will be assumed that it is empty. Bricks are placed on the loader by an operator using a conventional counterweighted clamping device with which a predetermined number of bricks, for example 12, is taken from a pallet or pack and placed in a row on the rollers of station 1. The stations are numbered from the left hand end of the loader as shown in FIG. 1. At station 1 there is provided an expanding belt 17 the operation of which is illustrated in FIGS. 2 and 3. The belt 17 is arranged so that it lies normally at a lower level than the rollers 16. After the row of bricks has been placed on the rollers 16 the belt 17 is raised by means of the jacks 18 to lift the bricks from the rollers as illustrated in FIG. 2 (the rollers are not shown in this figure). Jacks 19 are then used to expand the belt 17 to the position shown in FIG. 3. The effect of this is that bricks carried on the belt 17 are moved from a position in which they are in close contact to one in which they are equally spaced across the width of the belt. The jacks 18 then act to lower the bricks back onto the rollers 16. These rollers are continually rotating and if there is no obstacle to the motion of the row of bricks these will be moved forward to station number 2. There are however provided at each station stops 20 that can be raised and lowered by means of jacks 21. In FIG. 5 the stop 20 at the first station is shown in the raised position and it will be seen that in this position it prevents bricks on the rollers 16 of station 1 from moving forward. At each station a stop is provided for each individual brick and in the first five stations these stops are raised and lowered simultaneously. At station 6 however the stops are arranged to be controlled independently.

Bricks are loaded onto station 1 and move forward to fill the first five stations. If station 6 is empty the bricks from station 5 will be carried forward to station 6. If during the operation of the loader station 6 becomes empty the stops are removed from stations 1 to 5 simultaneously and the bricks on these move forward so that station 6 becomes filled.

Bricks are supplied from station 6 either individually or in groups to station 7 to form a pattern of bricks at that station corresponding to the pattern of bricks required by the brick loading machine to form a panel of a desired configuration.

At station 7 are two conveyors 22 and 23 each conveyor terminating at its inner end at the midline of the frame 13. The conveyors 22 and 23 are used to move bricks delivered from station 6 to station 7 across the width of the frame. It will be seen that station 7 is the full width of the receptacle 10 as are stations 8 and 9 whereas the preceding stations are narrower. In the embodiment shown in FIG. 1 the receptacle 10 is arranged to accommodate 24 bricks across its width whereas stations 1 to 6 accommodate 12. The receptacle and the various stations may be constructed to accommodate a greater or lesser number of bricks as desired.

Figure 9:
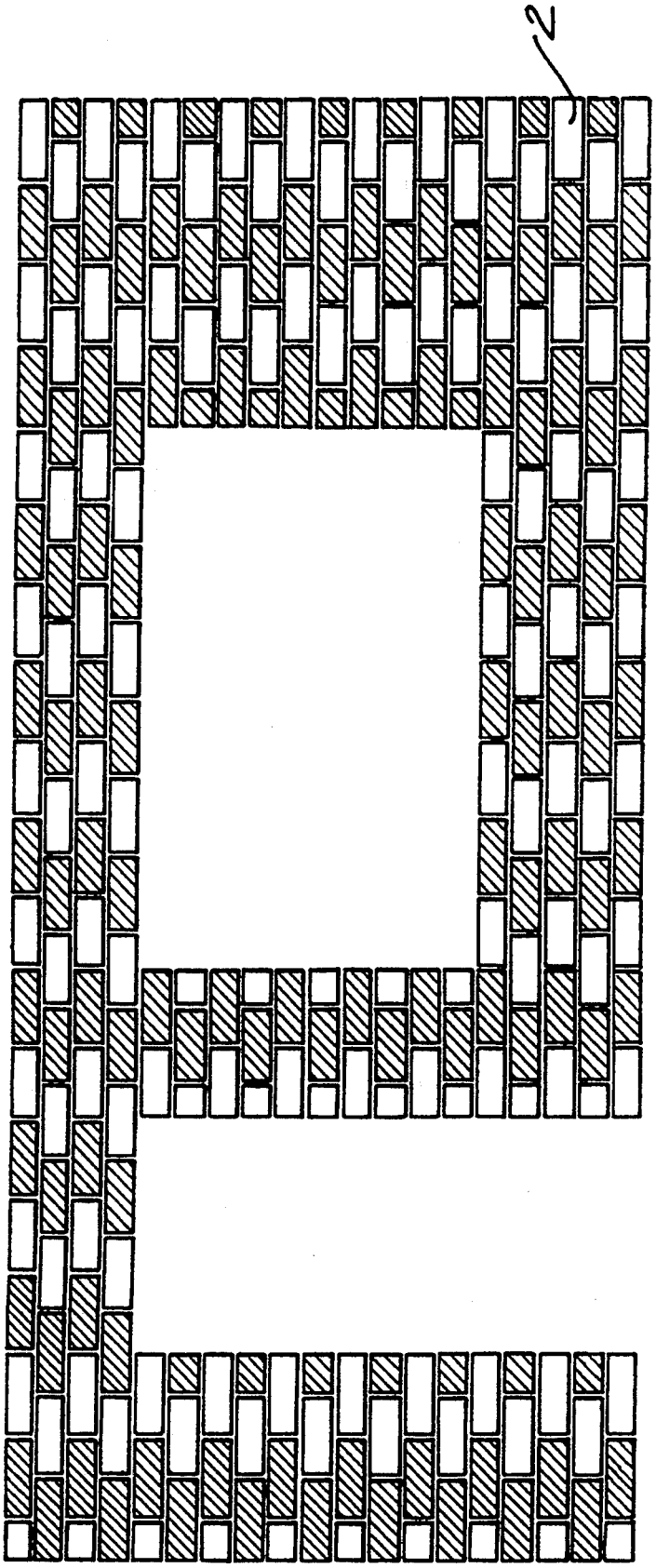
FIG. 9 is a view of a typical brick panel to be formed by the brick placing machine.

The whole operation of the loader is controlled by a PLC (programmable logic controller) which is programmed for the formation of a particular brick panel, such as for example, that illustrated in FIG. 9. The programming of such a PLC is not described in this specification as it would be a routine matter for a skilled programmer. The PLC controls the operation of stops 20 and conveyors 22 and 23 and all other moving parts of the machine so that bricks are formed up at station 7 in the correct configuration for the next portion of the panel to be formed. It will be seen from FIG. 9 that where door and window openings are to be formed in the panel fewer bricks will be required and at these positions only the appropriate number of bricks must be fed to the receptacle 10.

After bricks have been assembled in the correct configuration at station 7 they are moved forward to station 8 by retraction of the appropriate stops 20 and from station 8 to station 9 where they come under the influence of the pushing device 24 which can be lowered behind the bricks in station 9 by the jacks 25 and moved forward by the jacks 26 so as to push bricks at station 9 into the receptacle 10. The pusher 24 is constructed so that when the bricks enter the receptacle 10 they are in a staggered relationship as shown in FIG. 1. After transfer of the bricks to the receptacle 10 the pusher 24 is returned to its original position. The receptacle 10 will have now received its correct number of bricks and will act to clamp them and deposit them on the mould 11 in the manner described in the abovementioned patent specification. After releasing the bricks onto the mould 11 the receptacle 10 returns to its previous position and the whole cycle recommences. On each occasion that the receptacle 10 is filled it is filled with precisely the correct number of bricks arranged in the correct positions to form the next stage of the panel being laid down on the mould 11.

Figure 6:
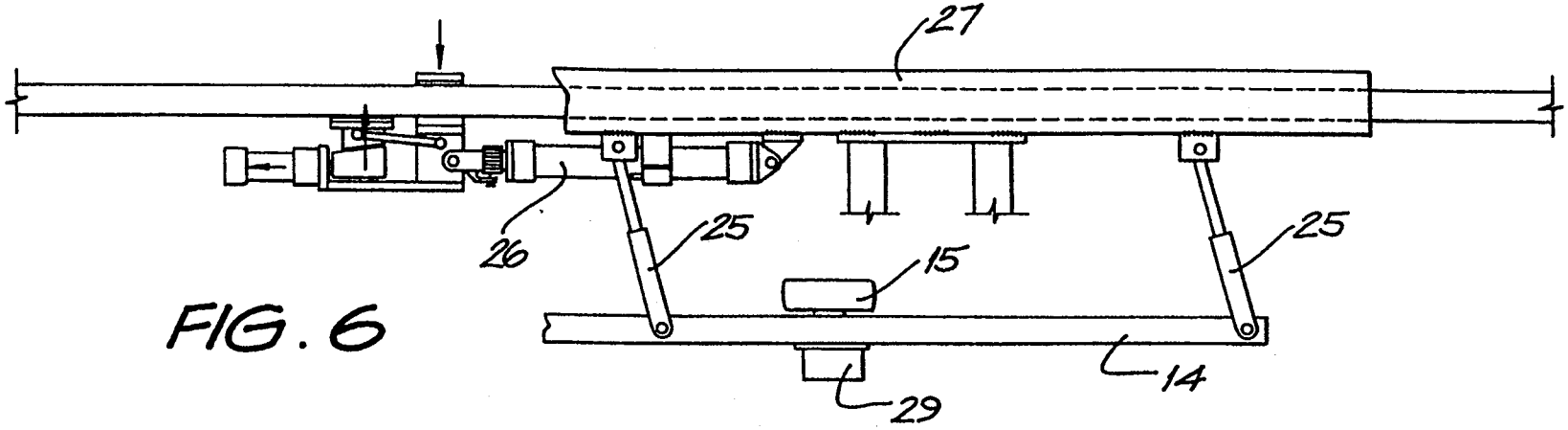
FIGS. 6, 7 and 8 are plan views of the mechanism by means of which the loader is moved in accordance with movements of the brick placing machine.
Figure 7:
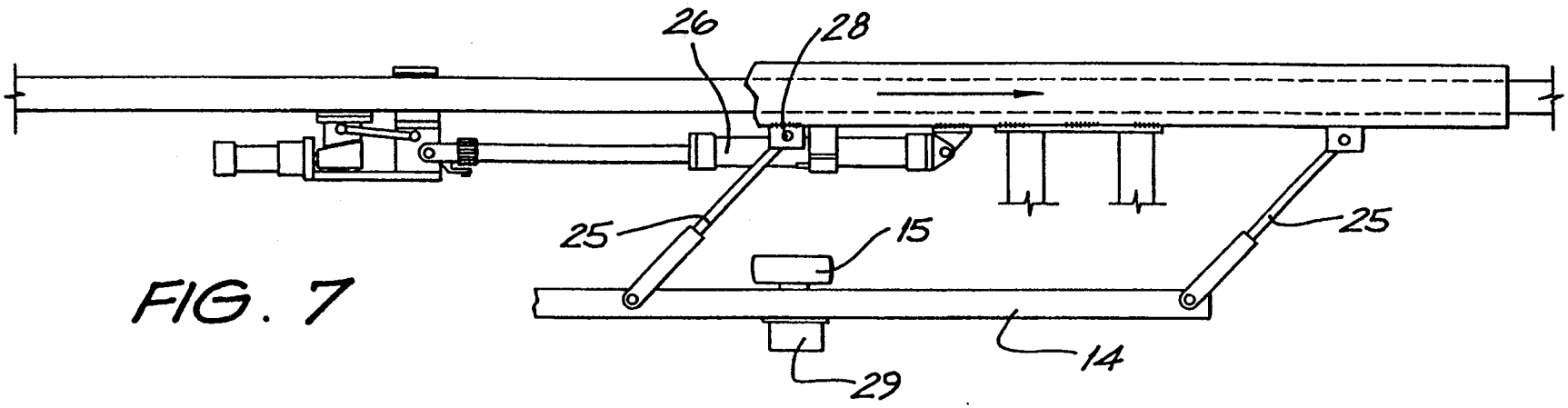
Figure 8:
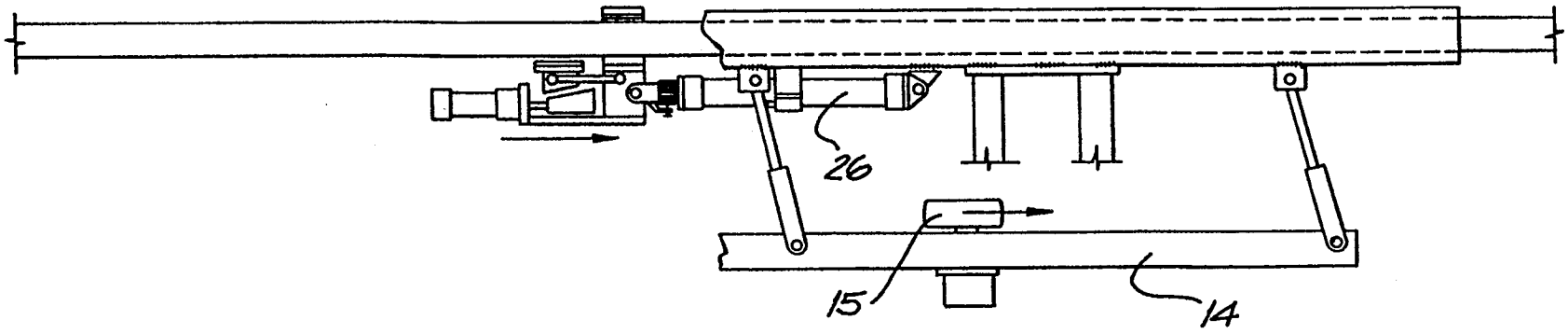

As illustrated in FIGS. 6, 7 and 8 the frame 7 is connected to the brick placing machine by means of the swinging arms 25. After each operation of the receptacle 10 to deliver bricks onto the mould 11 the brick placing machine is moved forward by the jack 26 in the manner described in the abovementioned specification. As the member 27 of the brick placing machine is moved from the position at FIG. 6 to that of FIG. 7 the arms 25 move in the manner shown and on taking up the position shown in FIG. 7 they actuate a valve 28 that has the effect of energizing a slave hydraulic motor 29 which drives the wheel 15 and thus moves the frame 14 of the loading machine forward as illustrated in FIG. 8. The motion of the loader will thus follow very closely the motion of the brick placing machine.

In an alternative form of construction, instead of using the pusher 24 to transfer bricks to the receptacle 10, the receptacle 10 may be constructed so as to be capable of rotating about a median longitudinal axis so that it can be rotated and brought over on top of bricks at station 9 and clamped about these bricks. It is then returned to the position shown in FIG. 1 and operates as described above. This form of construction is to be preferred as being simpler and more effective in operation than the use of the pusher 24.

The embodiment of the invention described is given by way of example only as constituting one form of apparatus within the general scope of the invention as defined above.

I claim:

1. A loader for an automatic brick placing machine comprising a frame, means for attachment of the frame to a receptacle of a brick placing machine for translational movement therewith, a plurality of motor driven rollers for the receipt of bricks arranged on the frame, said rollers being arranged in parallel at a plurality of stations and being constructed and arranged to move bricks towards a station from which the bricks are transferred to a brick placing machine, said stations including a first station having means for receiving a row of bricks in a close side by side configuration and moving said bricks into a configuration in which they are equally spaced apart at a predetermined interval, means at each station actuable to prevent movement of any brick caused by the rotation of one of said rollers, a final station for receiving a predetermined number of bricks arranged in predetermined position in accordance with the requirements of the brick placing machine in the formation of a brick panel, means to transfer said last mentioned bricks from the said final station to the receptacle of a brick placing machine while preserving the relative positions of said bricks, a pre-final station prior to said final station having means for moving bricks received from a previous station along the pre-final station to predetermined positions for transfer to the final station and a programmable logic controller control device programmed to control the movement of moving parts of the loader to effect movement of the bricks through the loader to transfer bricks to the brick placing machine in accordance with the requirements of a brick panel being formed by the brick placing machine.

2. A loader as claimed in claim 1 wherein the means for moving the bricks into a configuration in which they are equally spaced apart at a predetermined interval comprise an expanding belt arranged below the bricks, means to raise the belt into contact with the bricks and to lift them free of underlaying rollers, each brick being supported on a separate part of the belt and means to expand the belt to separate said parts a distance corresponding to said predetermined interval.

3. A loader as claimed in claim 1 or claim 2 wherein each said motor driven roller consists of a central axle and a surrounding tube connected to the axle through a clutch, the axles being continually rotated, the clutch permitting the rotation of the tube to stop on movement of a brick or bricks being prevented.

4. A loader as claimed in claim 1 wherein the means at the pre-final station for moving bricks along the station comprise two conveyors arranged end to end and extending longitudinally of the station.

5. A loader as claimed in claim 1 wherein the transfer of bricks from the final station to the receptacle comprises a pusher arranged to push bricks in a staggered relationship onto the receptacle.

6. A loader as claimed in claim 1 supported from the ground on wheels with at least one of which motor means is associated, the loader being attached to the brick placing machine by means of swinging arms, the arrangement being such that movement of the machine changes the angular relationship between the arms and the machine to cause operation of means to actuate said motor means to cause the loader to move in the direction of movement of the machine to restore the relationship of said arms with the machine.

* * * * *